US005947100A

United States Patent [19]

Anderson

[11] Patent Number: 5,947,100

[45] Date of Patent: Sep. 7, 1999

[54] PAINT BALL GUN AGITATOR SOUND TRIGGER AND DURATION CONTROL

[76] Inventor: Joel A. Anderson, 2311 Frontage Rd. N., Waite Park, Steams, Minn. 56387

[21] Appl. No.: 09/131,816

[22] Filed: Aug. 10, 1998

Related U.S. Application Data

[63] Continuation-in-part of application No. 08/846,574, Apr. 30, 1997, Pat. No. 5,791,325.

[51] Int. Cl.[6] ..... F41B 11/02

[52] U.S. Cl. ..... 124/45; 124/49; 124/72; 124/74

[58] Field of Search ..... 124/45, 49, 50, 124/72, 74

[56] References Cited

U.S. PATENT DOCUMENTS

| | | | |
|---|---|---|---|
| 3,695,246 | 10/1972 | Filippi et al. | 124/11 |
| 4,004,495 | 1/1977 | Belfer | 89/42 B |
| 5,052,138 | 10/1991 | Crain | 42/1.02 |
| 5,097,816 | 3/1992 | Miller | 124/49 |
| 5,282,454 | 2/1994 | Bell et al. | 124/49 |
| 5,285,765 | 2/1994 | Lee | 124/50 |
| 5,327,878 | 7/1994 | Wittbrot | 124/41.1 |
| 5,402,678 | 4/1995 | Fritz et al. | 73/167 |
| 5,505,188 | 4/1996 | Williams | 124/74 |
| 5,511,333 | 4/1996 | Farrell | 42/49.01 |
| 5,553,857 | 9/1996 | Fish | 473/209 |
| 5,605,461 | 2/1997 | Seeton | 434/21 |
| 5,791,325 | 8/1998 | Anderson | 124/56 |

*Primary Examiner*—J. Woodrow Eldred
*Attorney, Agent, or Firm*—Albert W. Watkins

[57] ABSTRACT

A paint ball gun includes an agitator mounted on the end of a rotary motor shaft. The agitator has a main shaft that extends transverse to the motor shaft, and two arch wires extending from the main shaft. Each arch wire begins at an end of the agitator shaft and extends vertically therefrom. The arch wires then wrap downward in a partial helix. The end of the arch wires opposite the vertical ends attach to the agitator shaft in a horizontal plane more centrally along the agitator shaft. Rotation of the motor shaft is controlled by an electronic circuit having a duration control which delays turning off the motor for a predetermined interval. The motor will remain activated continuously during a rapid firing sequence. In addition, a magnetic sensor is disclosed to trigger the electronic circuit into energizing the motor. The combination of sensor trigger, duration control and agitator design provide a greatly enhanced paint ball gun capable of operating without jamming or undesired noise during non-firing periods. In addition, the paint ball gun may be capable of rapidly firing more paint balls than previously known in the art, with reduced battery drain. A sound or pressure wave activated sensor such as a pressure or shock sensor or microphone is also disclosed which provides all components necessary for activating the magazine agitator within or immediately adjacent to the agitator motor, thereby simplifying retrofit capability and disassembly, while also improving resistant to paint blockage.

16 Claims, 7 Drawing Sheets

PAINT BALL GUN AGITATOR SOUND TRIGGER AND DURATION CONTROL

CROSS REFERENCE TO RELATED APPLICATIONS

This application is a continuation-in-part (CIP) of U.S. application Ser. No. 08/846,574 filed Apr. 30, 1997, allowed to issue as U.S. Pat. No. 5,791,325 on Aug. 11, 1998.

BACKGROUND OF THE INVENTION

1. Field of the Invention

This invention pertains generally to paint ball guns used for recreational and training purposes. For the purposes of this disclosure, paint ball guns are specifically defined as apparatus that propel gelatin capsules filled with paint from a barrel in rapid succession and at relatively high speeds. The paint ball capsules are designed to break upon impact with an object or person, thereby rendering an identifiable mark without injuring the person or object. The present invention more specifically pertains to an electronically controlled magazine that stores and feeds paint balls into a firing chamber at enormous rates.

2. Description of the Related Art

Paint ball guns can fire in rapid succession a relatively large number of paint balls in a short period of time. A magazine stores the paint balls until the balls are delivered to the gun firing chamber. The guns use compressed gas as the propellant, and are usually triggered by a user squeezing a conventionally shaped gun trigger. When the gun user repeatedly squeezes the trigger, the gun should continue to fire paint balls as rapidly as possible. Guns may be manually loaded before each shot, but most are either semi-automatic, where each time the trigger is pulled a paint ball is fired, or fully automatic, where the balls are fired as quickly as the gun is capable of for as long as the trigger is pulled.

Quite unlike conventional explosive-propelled munitions, paint balls are relatively round and have an exterior formed from a semi-rigid gelatinous compound. The gelatinous compound is known to be affected somewhat by such variables as temperature and relative humidity, and is of course somewhat frangible. During a firing sequence, paint balls on occasion lodge against each other or other objects and block the passageway to the firing chamber, resulting in a jam. While jamming is not new, knowledge from explosive munitions magazines is of little use with the very different paint balls.

Basic paint ball magazines are little more than large hoppers with a feed tube extending therefrom, a sort of closed funnel through which paint balls are dropped into the firing chamber. Unfortunately, the passageway must ultimately taper to isolate single paint balls therein. Usually this is not a gradual taper, but a sudden transition, to reduce the likelihood of two balls getting stuck against each other. Unfortunately, when one paint ball does lodge against the other, the user must shake the gun to free the balls.

One method of preventing paint ball jams is proposed by Miller in U.S. Pat. No. 5,097,816. Therein, a large helical magazine is provided through which the paint balls pass in a single row, eventually leading to the firing chamber. Unfortunately, the Miller design does not use space efficiently, requiring a large helical path with the center portion thereof unused. The extra dimension is undesirable. Furthermore, because of the reduced slope of the surfaces heading into the firing chamber, actual feed rates may be reduced and paint balls may not be provided at speeds sufficient to meet the needs of the more rapidly firing guns. Cleaning of the Miller construction, which is necessary over time to ensure smooth feeding of the paint balls, is difficult also due to the inaccessibility of the central loops of the helix.

Farrell in U.S. Pat. No. 5,511,333 also illustrates a magazine designed not to jam. Unfortunately, the straight tube design severely limits the number of balls contained within a single magazine. When a rapid fire sequence is initiated, the gun may not jam, but it is highly probably that the magazine will empty, still rendering the gun temporarily disabled.

U.S. Pat. No. 5,282,454 to Bell et al discloses a large magazine with sloping ends and side walls that lead downward to a tubular passageway referred to as a feed tube. Gravitational forces tend to urge the paint balls to the feed tube, as known in the prior art. The magazine is large, capable of holding many paint balls at a time. The feed tube is connected to the firing chamber of the gun, so that as the paint balls are carried through the tube, they are fed into the firing chamber. Occasionally, a pair of paint balls will simultaneously drop into the opening of the feed tube so that neither can pass, leading to a jam.

To prevent jamming of this type, the Bell et al patent proposes an agitator paddle to stir the paint balls. The agitator paddle may slightly overlap the feed tube opening. In addition to directly clearing any jams at the feed tube opening, the agitator paddle also keeps other paint balls within the magazine moving and available for feeding through the tube. If the gun is tilted slightly, the agitator paddle will tend to stir the balls and encourage them to move around, with the increased likelihood that they will continue to pass into the feed tube.

Since the agitator paddle is driven by a small DC motor, batteries are required. Unfortunately, the battery drain is significant. To preserve the battery during periods of non-use, as well as ensure that a user may stay quiet, absent the sounds of the motor and agitator, Bell et al disclose an optical sensor within the feed tube which detects paint balls within the tube. When no ball is present, an electronic circuit triggers the motor to spin the agitator. As soon as a paint ball blocks the optical path, the motor is again stopped.

While the Bell et al design enhances the rate at which paint balls may pass into the feed tube and has enhanced the sport, improved guns and occasional mishaps have revealed limitations therein. First of all, the simple paddle shown in the Bell et al patent, while helpful, still does not ensure sufficient feed rates for some of the newer model guns. To overcome this feed rate limitation, newer designs include higher power motors propelled by twice as many batteries. The standard model agitator is propelled by a single nine volt battery, while the enhanced version is propelled by two nine volt batteries. In addition, the paddle has been redesigned to have four flat surfaces extending longitudinally parallel with the motor shaft and radially therefrom, equidistantly spaced at 90 degree intervals. While this model improves the feed rate significantly, the added weight and cost of the additional battery is certainly undesirable. Furthermore, the added size of the battery compartment makes the gun an easier target for an opponent to hit.

A second limitation of the Bell et al design comes from the occasional, albeit infrequent, breakage of a paint ball. When a paint ball breaks, the optical sensor of the Bell et al design is rendered inoperative, and the sensor must be carefully cleaned.

A third limitation of the Bell et al design is the sensor reacting not to demand from the gun to trigger the agitator, but instead to presence of balls within the feed tube. Consequently, when a rapid fire sequence is initiated, the agitator is slow to start rotating. Furthermore, each time a ball passes through the feed tube, the optical sensor is interrupted, and the agitator stopped momentarily.

Williams, in U.S. Pat. No. 5,505,188 discloses a further alternative. A coiled tube within the magazine chamber is pressurized during the firing process to force balls into the feed tube. During rapid fire sequences, the magazine is certainly agitated by motion of the coiled tube. However, the coiled tube does not positively clear the feed tube opening and so can, in some instances, actually create a jam at the feed tube inlet.

SUMMARY OF THE INVENTION

In a first aspect of the invention, a controller for a paint ball gun magazine agitator motor includes a firing sensor which uses sound, pressure variations or shock waves to sense a gun firing event and, in response thereto, generates an electrical firing indicator signal; means for prolonging the firing indicator signal; and means for activating the paint ball magazine agitator motor responsive thereto.

In a second aspect of the invention, a sound activated relay for powering a paint ball magazine agitator comprises a microphone for receiving pressure waves and converting them to microphonic electrical waves; an envelope threshold detector which detects when the envelope of microphonic electrical waves exceeds a threshold voltage and provides a threshold output voltage representative thereof; a timer which extends the pulse duration of the threshold output voltage; and a relay which responds to the extended duration pulse and provides electrical energy to an agitator motor, the motor consequently providing motive power to said agitator.

In a third aspect of the invention, a method of refilling a paint ball gun magazine feeder tube comprises the steps of detecting pressure waves in a medium; initiating an electrical pulse responsive to the pressure waves, of duration greater than the duration of the pressure waves; activating a paint ball agitator responsive to the electrical pulse and thereby moving paint balls into said feeder tube.

OBJECTS OF THE INVENTION

A first object of the present invention is to enable a rapid fire paint ball gun to fire paint balls on demand at all times. A second object is to accomplish rapid firing with a minimum of accessories. Another object of the present invention is to provide a retro-fit capability to existing guns, to allow upgrade of existing equipment. A further object of the present invention is to ensure continued rapid firing even when a paint ball inadvertently spills paint within the feed tube. These and other objects of the invention are accomplished by the preferred embodiment described hereinbelow and illustrated in the attached drawing figures.

DESCRIPTION OF THE PREFERRED EMBODIMENT

Figure 1:
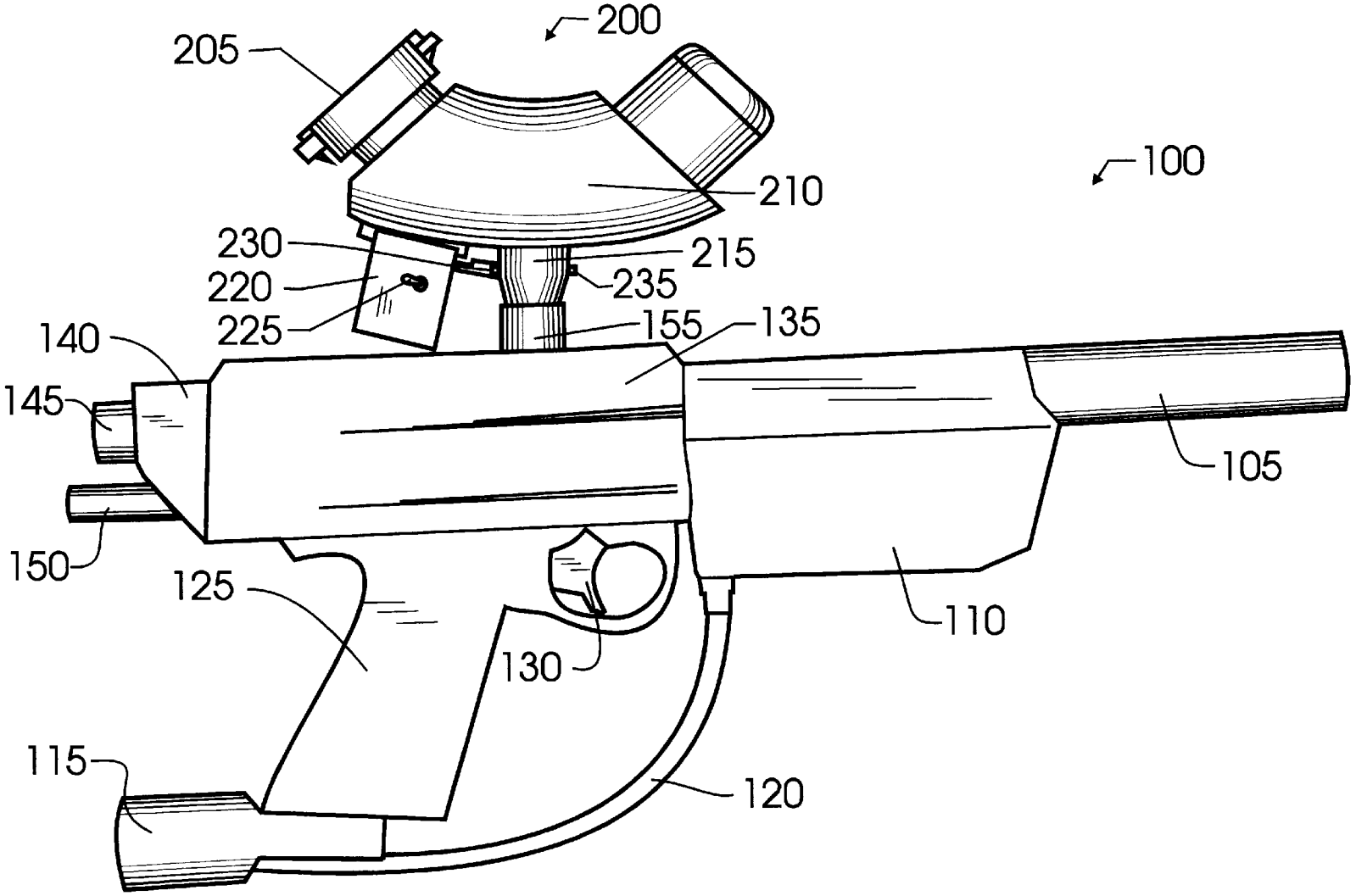
FIG. 1 illustrates a paint ball gun in a ready position, including features of the present invention.
Figure 2:
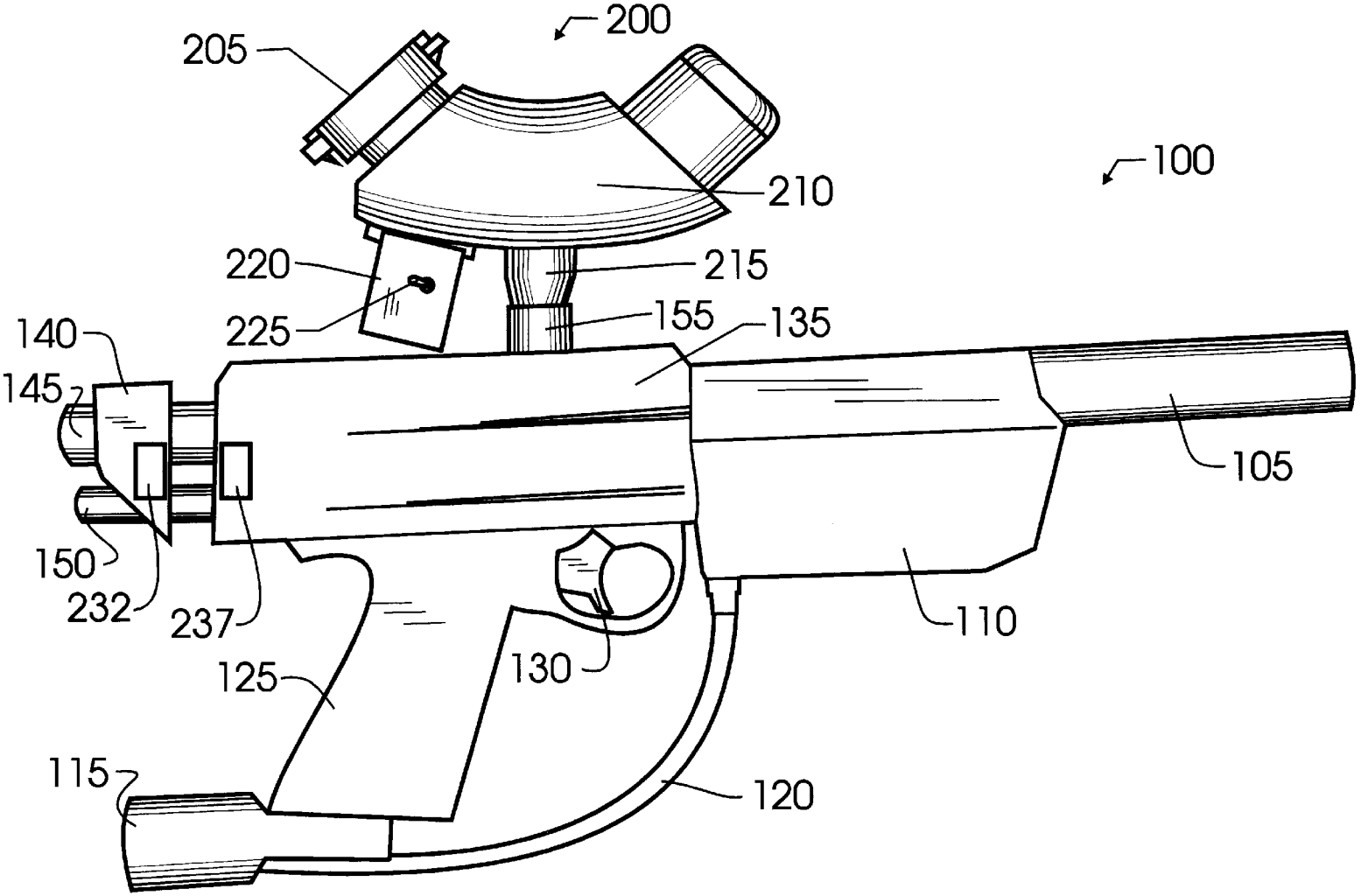
FIG. 2 illustrates the paint ball gun of FIG. 1 in a "cocked" position, and showing an alternative embodiment sensor.

Paint ball gun 100 is shown by side view in a "ready" position in FIG. 1 and in a "cocked" position in FIG. 2. Gun 100 includes a barrel 105, pressure valve and hand grip 110, pressure tank coupler 115 and hose 120. One hand of a user may support gun 100 at pressure valve cover 110, while the other hand will grip handle grip 125. One finger, usually the pointer, will wrap around trigger 130, and may be used to squeeze trigger 130 to activate the firing process. When trigger 130 is squeezed, movable bolt stop 140, slidable bolt 145 and slidable valve 150 may all be moved away from gun housing 135 into position as shown in FIG. 2. The exact sequence and operation of the pressure valve, bolt stop 140, slidable bolt 145 and slidable valve 150 are unimportant to the present invention, well known in the field, and achievable through several known alternatives.

Magazine 200 attaches to paint ball inlet 155 through feed tube 215. Surrounding feed tube 215 is an optical sensor pair 230 and 235, which detect by light wave whether a paint ball is present within feed tube 215. Connected to sensor pair 230, 235 is a battery, motor and electronics compartment 220 having a power switch 225 for energizing the optical sensors and electronics.

In operation, a user may dispense paint balls into magazine 200 through cover 205, into magazine chamber 210. A source for pressurized gas will be connected to pressure tank coupler 115, and pressurized gas will be conducted through hose 120 into a pressure valve within the gun. Depending upon the particular sensor and circuitry used, the user may next activate the battery, motor and electronics compartment by switching on switch 225. The gun is then in a "ready" state, whereby squeezing trigger 130 will start the firing process.

FIG. 2 illustrates gun 100 more specifically in the "cocked" state, with movable bolt stop 140 separated slightly from gun housing 135. This is the position of the gun just prior to firing. In FIG. 2, an alternative embodiment sensor is illustrated which uses a magnet 232 and a magnetic field sensor 237. When the gun is in the ready state of FIG. 1, sensors 232, 237 will indicate that there is no demand for paint balls. Once the gun moves to the cocked state of FIG. 2, sensors 232, 237 will indicate a demand for paint balls. The output from sensor 237 will be conducted to electronics within compartment 220 and described hereinbelow, which will ultimately trigger a motor to turn. While the magnet 232 and sensor 237 are illustrated mounted externally on the gun, one skilled in the art will observe that the slidable bolt 145 may, for example, be modified to include a magnet therein, closer to barrel 105. Sensor 237 may then be inserted into housing 135, and not be visible at all from an exterior view. Housing 135 is most typically fabricated from aluminum, so no distortion of the magnetic field will occur. Caution should be taken, however, to ensure that sensor 237 is not placed so closely to compartment 220 as to be affected by any stray magnetic fields which may emanate from the motor therein. Since magnet 232 requires no electrical connection, magnet 232 may be placed at any convenient point within the gun where movement may be sufficient to trigger sensor 237. In addition, magnet 232 may not have to move. Instead, a magnetically permeable material may be moved and thereby distort the magnetic field sufficiently to be detected by sensor 237.

While the bolt 145 and stop 140 have been specifically described as suitable locations for magnet 232, the invention is not so limited and other locations such as within trigger 130 have also been conceived of. As noted above, the only requirement is that sensor 237 be able to detect a change in the magnetic field emanating from magnet 232 and not provide false output due to stray fields or signals.

Magnetic field sensor pair 232, 237 is more immune to dirt, paint or other contamination than optical pair 230, 235. Even in the unfortunate event that a paint ball 240 should break within magazine chamber 210 or feed tube 215, the user will more quickly be able to restore the gun to functional condition. As an added advantage, if a magnetically actuated reed switch is used for sensor 237, an alternative circuit such as FIG. 7 described hereinbelow may be used which does not require any stand-by power. The user may then immediately operate the gun without troubling with switches, and, when finished, store the gun without fear of draining the battery during non-use.

Figure 3:
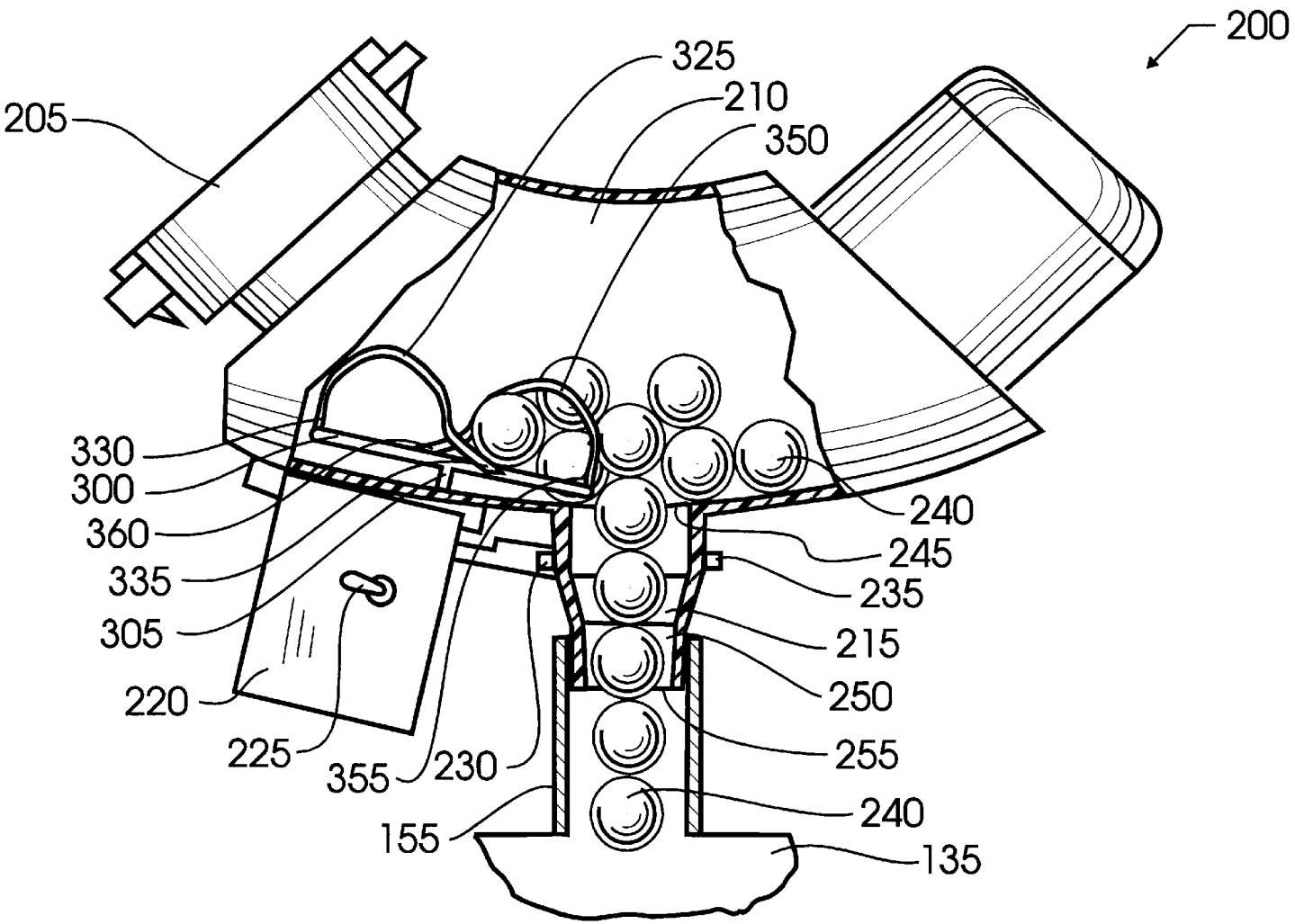
FIG. 3 illustrates a partial cut-away view of the paint ball magazine of the present invention.

FIG. 3 illustrates the magazine of the present invention by partial cut-away view. Within magazine chamber 210 are a number of paint balls 240. Also within chamber 210 is paint ball agitator shaft 300, which is caused to rotate by motor shaft 305. Onto agitator shaft 300 are mounted two wires 325 and 350. Wire 325 connects to the top surface of shaft 300 at connection 330, which can be a weld, braze, solder, glue or any other similar attachment, or wire 325 may even be a continuation of shaft 300 which has been appropriately bent or formed. In the preferred embodiment, wire 325 extends at first vertically from shaft 300, and then begins an arc back down towards shaft 300 and finally is reconnected thereto along a side thereof at horizontal connection 335. Similarly, wire 350 extends vertically from connection 355 and then wraps around to side connection 360.

Feed tube 215 forms a sharp transition with magazine chamber 210 at transition 245. In the preferred embodiment, agitator shaft 300 overlaps with transition 245 slightly, such that if two balls 240 should drop into feed tube 215 simultaneously and get lodged against each other at transition 245, agitator shaft 300 will serve to clear one of the balls. Feed tube 215 has a gentle taper 250 therein, which, although not absolutely necessary, helps to maintain exact spacing between magazine 200 and paint ball inlet 155 and helps to support magazine 200.

Figure 4:
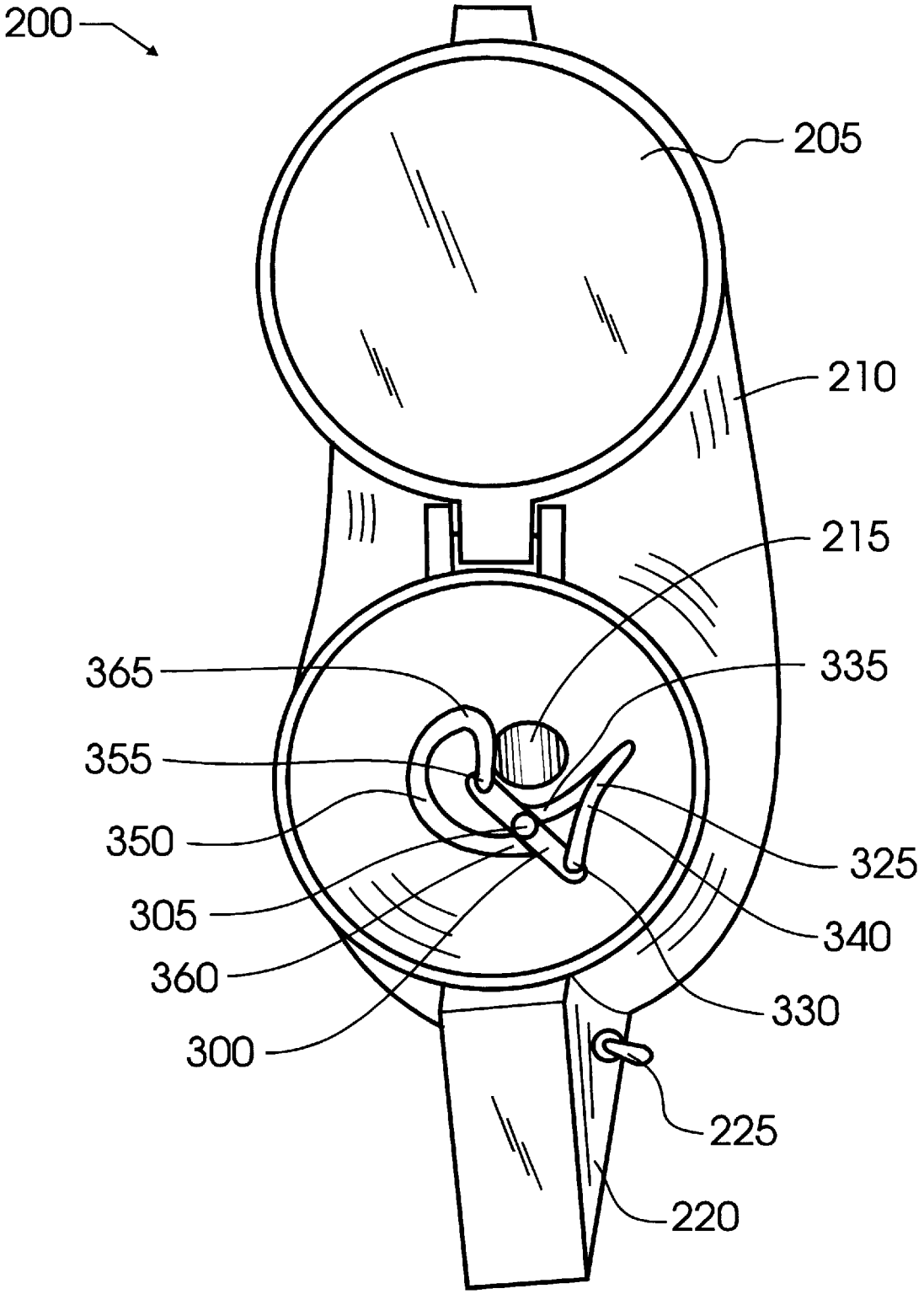
FIG. 4 illustrates a top projected view of the paint ball magazine of the present invention, with the cover raised to reveal the agitator features of the preferred embodiment.

FIG. 4 shows a top view of agitator shaft 300, wherein the arrangement of wires 325 and 350 are evident. Extending vertically from vertical connection 355 is a short segment 365. Since connection 360 is a side attachment to shaft 300, wire 350 forms a partial helix as it wraps down to shaft 300. From the perspective shown in FIG. 4, motor shaft 305 rotates in a clockwise direction. While not wishing to be limited by theory, it is believed that this configuration provides optimum geometry since rotation of wire 350 tends to help drive paint balls 240 toward feed tube 215. Wire 325 is similarly configured, though there is no requirement that this exact geometry be used for both. Furthermore, the invention is not limited to a wire, and may include a variety of other constructions or arrangements which will serve to accomplish the same function and which are too numerous to specifically mention. Among these may be solid, mesh or flexible paddles. However, this particular geometry is preferred for cost, ease of manufacture, simplicity, and ability to pass through the balls even when magazine chamber 210 is fully loaded. In the preferred embodiment, the entire agitator has been coated with a polymer protectant, which serves to prevent the agitator from corroding, softens impact with paint balls 240, and may provide better surface characteristics therebetween. Agitator shaft 300 is interconnected to sensors 230, 235 or the alternative sensors 232, 237 through an electronic control circuit located within compartment 220. While the electronics may be located in other suitable places, this compartment serves as an ideal central location for the electrical devices.

In the prior art, sensors 230, 235 were used to directly trigger a relay and activate the motor. This resulted in rapid starting and stopping of the motor during periods of rapid firing. As a result of the starting and stopping, and since motors draw more current and are less efficient during starting, the circuit tended to drain the battery more than is desired for the resultant feed rate.

Figure 5:
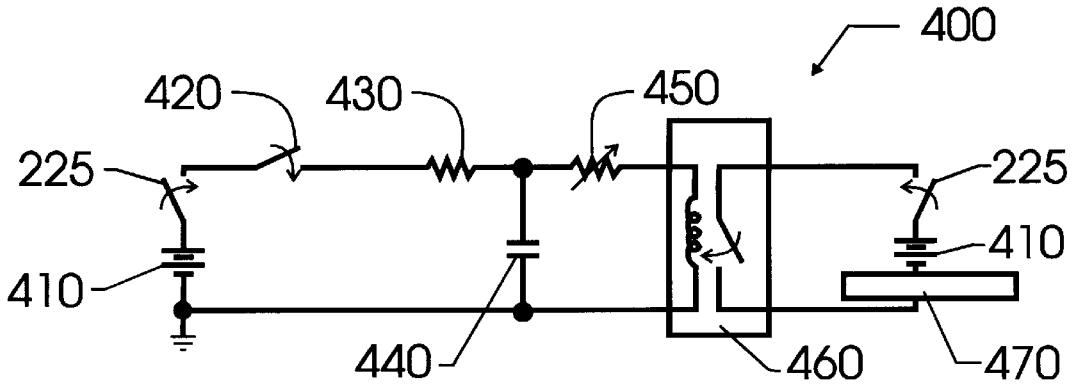
FIG. 5 illustrates a first electrical schematic of a timer delay circuit.

The present inventor has determined that during a rapid fire sequence, the motor will desirably run continuously. Yet, the motor should not be allowed to run for extended periods when not the gun is not firing, since this represents a substantial battery drain and also prevents a user from hiding in silence, absent the sound of the motor and moving paint balls. In the present invention, a motor control circuit 400 is provided such as shown in FIG. 5.

A single battery 410 provides power for both the motor 470 and the electronics. Battery 410 is switched completely off by switch 225, disabling both motor 470 and the electronics. When switch 225 is closed, by a user getting ready to use gun 100, switch 420 will stay open until a demand for paint balls 240 is detected. Switch 420 is the schematic representation of the switching function found in either optical receiver 235 or magnetic sensor 237, depending upon the embodiment chosen. Until a demand is sensed which will close switch 420, there is no power drawn from battery 410. Once switch 420 closes, current flows through in-rush resistor 430, thereby charging capacitor 440. In-rush resistor 430 is strictly provided to limit current flow into capacitor 440 and thereby protect switch 420 from damage due to excessive current flow. Therefore, in-rush resistor 430 will be a low value resistor, commonly around 10 ohms. Nearly instantaneously, the voltage across capacitor 440 will rise to full voltage, which in the preferred embodiment is nine volts. In this instant, as the voltage rises, sufficient current will pass through variable resistor 450 and the coil winding of reed relay 460 to trigger the switch portion of reed relay 460. This in turn closes the electrical circuit from battery 410 to motor 470, causing motor shaft 305 to begin rotating.

When the demand is no longer sensed by switch 420, thereby opening switch 420, motor 470 is not 0 immediately stopped. Capacitor 440 is a relatively high value capacitor, typically in the range of 470–1,000 micro-Farads. The energy stored by capacitor 440 is relatively slowly dissipated through variable resistor 450 and the coil of reed relay 460. As current flows through variable resistor 450, the voltage across capacitor 440 drops, until some minimum threshold current is reached. This minimum threshold current is dependent upon the characteristics of reed relay 460, which are usually published as part of the specification for the relay. Until the current through reed relay 460 reaches this minimum threshold, motor 470 will stay energized. In this way, a small delay is built into the shut-off of motor 470.

By varying the resistance of resistor 450, some control over the amount of time motor 470 runs after a demand has ceased is available. In the preferred embodiment, motor 470 will run long enough that, if a rapid fire sequence is occurring, power will never be interrupted to motor 470, thereby allowing motor 470 to run continuously without having to repeatedly restart. This time interval can be calculated as the time it takes gun 100 to reset and be ready to fire the next paint ball. If the shut-off delay time is at least as long as it takes gun 100 to reset, then the motor will not be turned off during a rapid fire sequence. In the preferred embodiment, the shut-off delay time may be several times the gun reset time to ensure that, even in extreme cases, the gun remains supplied with paint balls.

Figure 6:
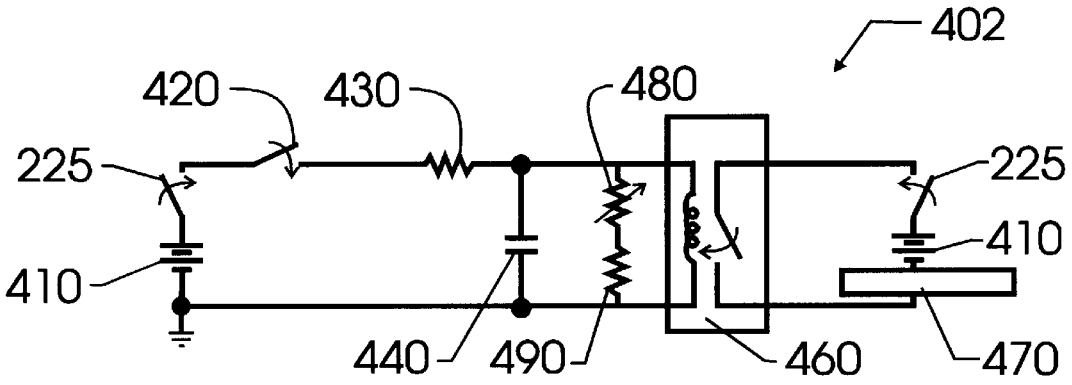
FIG. 6 illustrates a second embodiment thereof.
Figure 7:
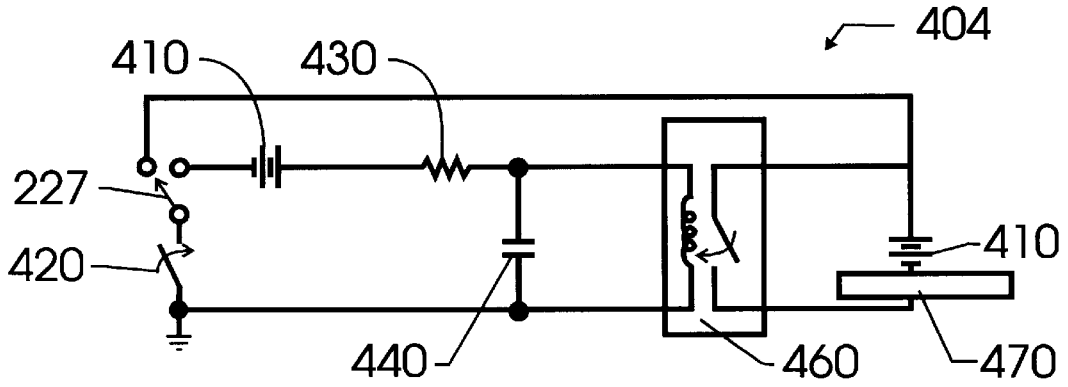
FIG. 7 illustrates a third embodiment.

Since strength of an electromagnet such as the coil within reed relay 460 is determined by current flow through the windings, variable resistor 450 may be replaced by variable resistor 480 and fixed resistor 490 shown in FIG. 6, which are in parallel to reed relay 460. Fixed resistor 490 is provided to limit current flow to some maximum amount, to prevent damage from excessive current flowing through variable resistor 480 in the event variable resistor 480 is set to zero resistance. A further alternative is shown in FIG. 7, where resistors 450, 480 and 490 are eliminated altogether. In this case, capacitor 440 must be selected with reed relay 460 to provide the desired duration after switch 420 opens.

FIG. 7 also illustrates by schematic other changes to the circuit which might be appropriate with a magnetic reed switch sensor 237. In this embodiment, there will be no drain upon the battery until reed switch sensor 237 is triggered. Therefore, on-off switch 225 is no longer necessary, and may be replaced by delay circuit bypass switch 227 of the single pole double throw variety. Switch 227 allows battery 410 to be connected directly to the motor, bypassing the delay circuit. A user may elect to set switch 227 this way in the event of a problem or failure within the electronic circuitry, or simply to save power when rapid fire sequencing is not required.

As is apparent from the schematics, any device which accomplishes the switching function of switch 420 can successfully serve as that circuit component. In the preferred embodiment, optical switch pair 230, 235 and magnetic switch pair 232, 237 are illustrated and discussed. However, mechanical switches, capacitive switches and other such known devices would all serve the purpose. Even trigger switches of various types could be satisfactory in the present invention. The selection of the particular device to serve the function of switch 420 will be dependent upon the particular gun 100 and the goals of the user.

Battery 410 may be any type of battery suited to the function, though in the preferred embodiment a nine volt alkaline battery is used. Other batteries including nickel-metal hydride, nickel cadmium, carbon cells, silver oxide and lithium batteries are all contemplated. Even lead-acid batteries could be considered, but for the weight of the batteries and the safety factor lead-acid would not be a battery of choice.

The above described combination of magazine 200, agitator shaft 300 with wires 325 and 350, and electronic circuit 400 provide an optimum feed of paint balls to a paint ball gun. Battery drain is kept to a minimum, and a user may stand silently in wait for a competitor. Jams are effectively eliminated. In fact, during rotation of motor shaft 305, paint balls 240 are kept continuously in motion within magazine chamber 210.

To verify the improvement from the agitator design, the two Bell et al prior art designs were compared to the present invention. As aforementioned, the first Bell et al design uses a stick type agitator with a single nine volt battery. The second design uses two nine volt batteries for added power, and an agitator with four equidistant radially extending paddles. Three magazines were each equipped with one of the aforementioned agitators and appropriate battery combination, and each was supplied with fresh alkaline batteries. Each magazine was positioned with feed tube 215 held in a vertical position, and then 150 paint balls were added to the magazine. The paint balls were from a variety of manufacturers, to reduce any variation that might be a result of a particular manufacturer's composition. The same 150 paint balls were used to test each of the three magazines. The test was a timed test to determine how long each magazine took to unload all of the 150 balls. Each of the three magazines were tested eight times, and the slowest and fastest times were disregarded to remove any timing variations. The average number of paint balls discharged per second was calculated, and the variance between the fastest and slowest was also calculated, since this represents the ability of the particular agitator to maintain consistent delivery rates.

TABLE 1

| | Bell et al 9V | Bell et al 18V | Present invention |
|---|---|---|---|
| Balls/second | 7.76 | 8.59 | 11.46 |
| Spread (seconds) | 2.32 | 2.03 | 0.71 |

As is apparent from table 1, the agitator and delay circuit of the present invention provides more than one and one-half times as many balls per second as the standard agitator of the prior art, with a much tighter spread, meaning more consistency of feed in addition to the higher feed rates.

As noted hereinabove, other types of sensors may be used to detect the demand for paint balls. As noted, the optical sensors of the prior art suffer when a paint ball spills paint into feed tube 215. In addition, these sensors suffer from situations where feed tube 215 may be emptied. For example, when a participant lays down or maneuvers in such a way as to tilt gun 100, feed tube 215 may empty. Such an event would cause the prior art optical sensor to activate, preventing the participant from proceeding in silence while also inhibiting the participant's ability to listen for other participants. In addition, when gun 100 is not in use, the agitator may activate if not switched off. As previously noted, the combination of a magnetically actuated reed switch for sensor 237 in combination with alternative circuit FIG. 7 does not require any stand-by power. The user may then immediately operate the gun without troubling with switches, and, when finished, store the gun without fear of draining the battery during non-use.

While magnetic sensors such as sensor 237 offer advantage in being insensitive to spilled paint, these magnetic sensors must be located on the gun 100 somewhere in the vicinity of a moving part such as trigger 130 or slidable bolt 145. As a result, the magazine may not be actuated without some type of electrical interconnection between magazine 200 and paint ball gun 100. Unfortunately, this type of electrical interconnection complicates retrofitting of existing guns, since wiring harnesses must be provided externally between the gun and the magazine, and removable electrical connectors must be provided to allow the user to fully remove magazine 200 from gun 100.

In an alternative embodiment, magazine 100 is triggered by sound. Sound activation offers several advantages over optical detection and magnetic detection, without the associated disadvantages. For example, sound activation has the added advantage of a magnetically actuated reed switch which does not require any stand-by power. Neither circuit is activated until gun 100 is actually fired. Therefore, the user may immediately operate the gun without troubling with switches, and, when finished, store gun 100 without fear of draining battery 410 during non-use. In addition, during maneuvers requiring gun 100 to be tilted and feed tube 215 emptied, motor 470 will not be triggered.

Figure 8:
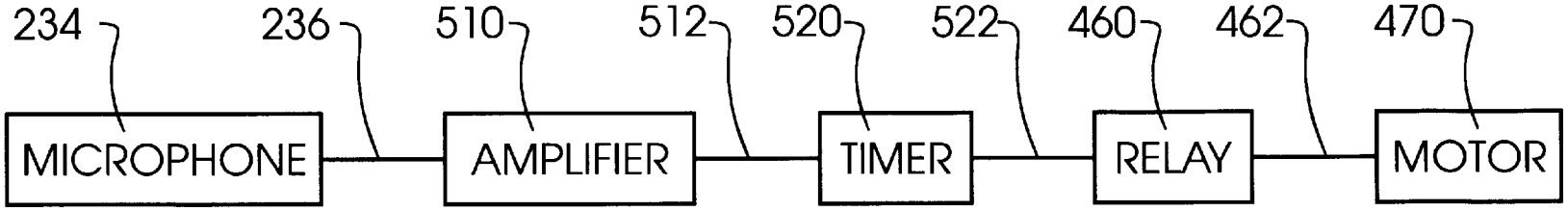
FIG. 8 illustrates by block diagram an electrical circuit for an alternative sound triggered agitator.

Each time paint ball gun 100 fires, a distinct set of frequencies of relatively large magnitude are generated by gun 100. A relatively low cost microphone 234 may be provided instead of either optical pair 230, 235 or magnetic pair 232, 237, as shown by block diagram in FIG. 8. While 234 is identified herein as a microphone, it will be recognized by those familiar with the sound detection art that device 234 may encompass any type of device which is capable of converting sound waves into detectable electrical changes. Moreover, other wave detector types of devices such as pressure sensors or shock sensors could also be used, and the waves do not have to be transmitted solely through the air, but instead may be transmitted through the gun materials. Nevertheless, a microphone is preferred herein since microphone 234 may be located directly on magazine 200, for example adjacent to or within battery, motor and electronics compartment 220, thereby eliminating any need for wires external of compartment 220.

Figure 10:
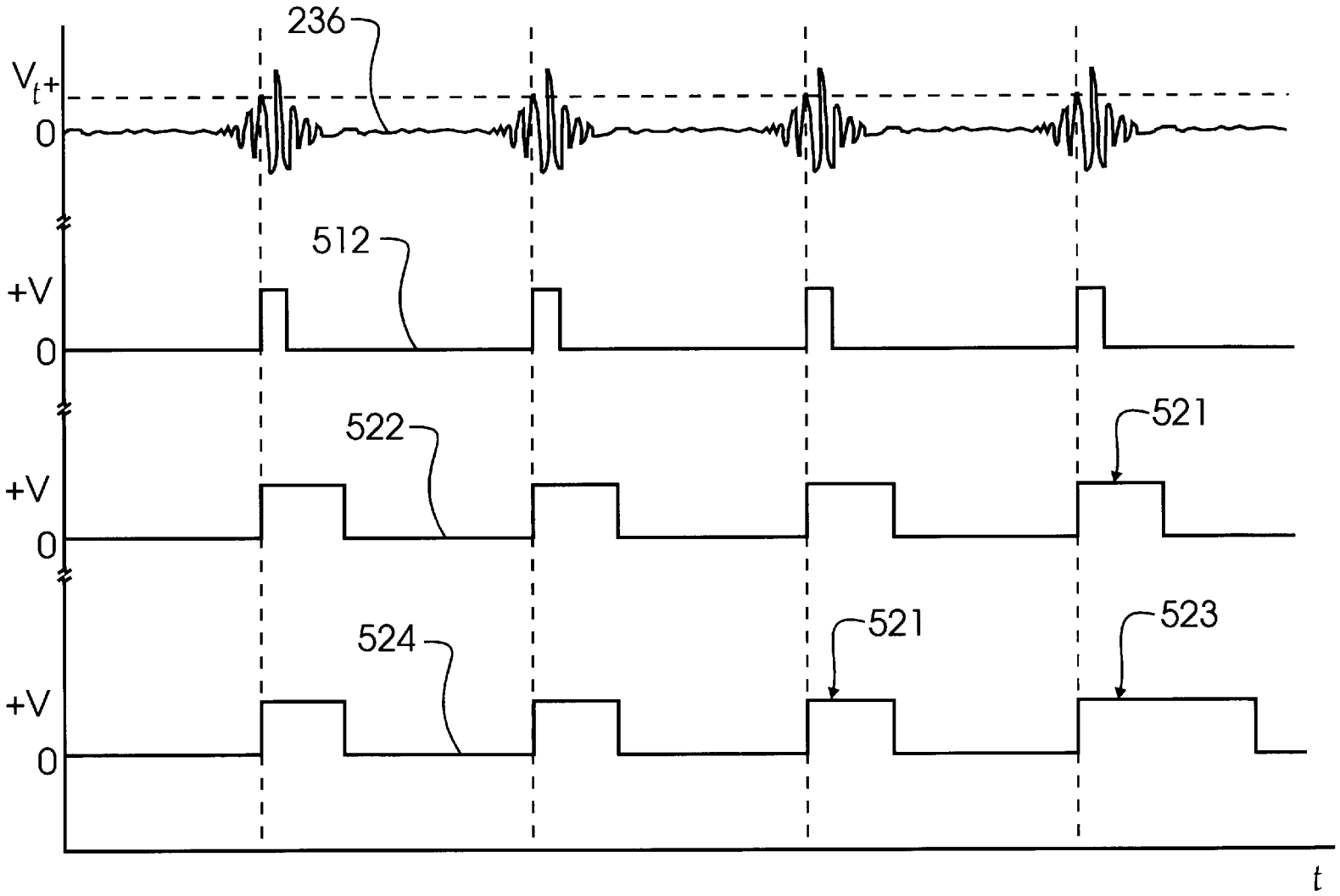
FIG. 10 shows the waveforms of various outputs from FIGS. 9 and 10.

The output 236 from microphone 234 will generally be too weak or of inappropriate character to directly use in other processing circuitry, so amplifier 510 may be provided. Amplifier 510 may perform a variety of additional functions incident to amplification, such as that of envelope detectors, comparators, limiting, buffering, and/or triggering of the nature of a Schmitt trigger. For example, if amplifier 510 is a high gain amplifier such as an op-amp type designated as a 741 style, or conceivably several of these in series, once a minimum peak threshold $V_t$ is reached as shown in FIG. 10, amplifier 510 may drive output 512 to full supply voltage. When the envelope of microphone output 236 falls below threshold $V_t$, amplified output 512 may be at a ground potential or negative supply, depending upon the type of amplifier circuitry selected. So while amplification is the primary function performed by amplifier 510, a variety of additional functions may be performed which are incident thereto and beneficial, as is known in the amplification art.

An amplified microphone signal 512 is conveyed from amplifier 510 to timer 520. Timer 520 then converts brief electrical impulses indicative of firing into longer duration pulse, for example of one-half second duration. This longer duration signal represents a demand for paint balls, since one ball has been used during firing, and relay 460 is then activated to provide full battery power to motor 470. FIG. 10 illustrates the relationship between signals 236, 512 and 522. Timer 520 may be a simple RC filter, or may comprise a more complicated circuit such as a 555 type timer or even a voltage controlled oscillator. The exact components used to fulfill the timing function are not critical to the invention, so long as the timing diagrams illustrated in FIG. 10 hold true to intent.

Figure 9:
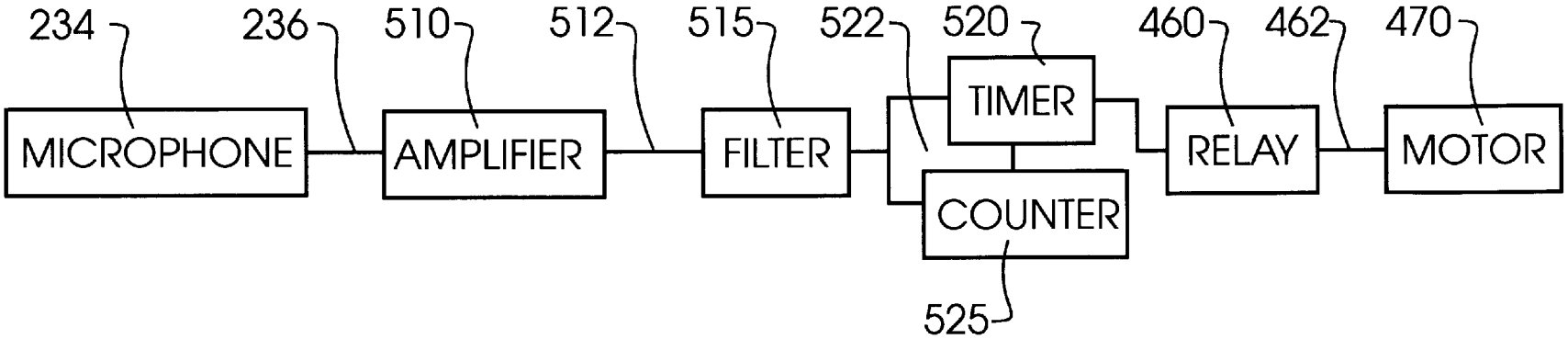
FIG. 9 illustrates by block diagram an alternative sound triggering circuit.

FIG. 9 illustrates an additional filter 515. This filter 515 may be a low, high or band-pass filter, depending upon the particular gun firing frequencies. Most typically, this will be a bandpass filter having a very narrow bandwidth, such that one or a few specific frequencies are selected which are only indicative of firing. The inclusion of filter 515 will help to prevent false triggering of motor 470 when other events occur that produce sound, such as when gun 100 is accidentally bumped against another object. While filter 515 is not essential to the proper functioning of circuit 500, some frequency discrimination may be desired, particularly for higher level competitions or premium guns and magazines. Filter 515 may be provided prior to amplifier 510, after amplifier 510 as illustrated, or integral therewith, particularly where operational amplifiers are used and gain may be readily combined with frequency selectivity.

An additional optional feature is illustrated in FIG. 9, by providing counter 525. Counter 525 provides feedback to timer 520 which is used therein to effect a change in timing duration. More specifically, every n times a pulse indicative of firing occurs, counter 525 adjusts the timing control of timer 520 to change duration of pulses on waveform 522. For example, as shown in FIG. 10, pulse 523 may be twice the duration of pulse 521. In the preferred embodiment, n might be equal to four, so that every fourth shot, timer 520 provides a one second pulse instead of the normal one-half second pulse. The increased duration may be achieved through the use of a transistor or other switch connecting or removing an additional timing component into/from the circuit, as is known in the art, or may alternatively be the result of a voltage control signal applied to a voltage controlled oscillator. These and a myriad of other frequency control techniques are well known in the art of timing duration control, and that knowledge is recognized as incorporated herein. This change in duration ensures that every nth shot, the magazine is thoroughly stirred to help ensure balls remain available. The value of n is preferably equal to the number of balls that are retained within feed tube 215, to ensure that feed tube 215 never empties, while still minimizing the duration of the majority of stir cycles to help conserve battery power.

While the foregoing details what is felt to be the preferred embodiment of the invention, no material limitations to the scope of the claimed invention are intended. Further, features and design alternatives that would be obvious to one of ordinary skill in the art are considered to be incorporated herein. For example, the preferred embodiment is illustrated with a single type of gun 100. Those familiar in the art will recognize the many variations of paint ball guns available on the market, and will immediately recognize to which the present invention may be applied. Other types of delay circuits may be utilized, and other types of agitators may find application of the delay circuit beneficial. In fact, the delay does not need to be electrical at all, and could comprise other devices which serve the same function as the electrical storage capacitor and circuit. In addition, there are a multitude of sound activated switches known in that art, the teachings of which will find various application in the sound activated agitator embodiments. The scope of the invention is set forth and particularly described in the claims hereinbelow.

I claim:

1. A controller for a paint ball gun magazine agitator motor comprising:

a firing sensor which uses pressure variations transmitted through a medium to sense a gun firing event and, in response thereto, generate an electrical firing indicator signal;

means for prolonging said electrical firing indicator signal to produce a signal indicating a demand for paint balls which is of greater duration than said firing event;

means for activating said paint ball magazine agitator motor responsive to said paint ball demand signal.

2. The controller of claim 1 further comprising an amplifier for amplifying said electrical firing indicator signal prior to said prolonging.

3. The controller of claim 2 wherein said amplifier performs a threshold detection function in addition to basic amplification.

4. The controller of claim 2 wherein said amplifier comprises an op-amp.

5. The controller of claim 1 further comprising a filter means for receiving said electrical firing indicator signal and selectively filtering a frequency range therefrom, and for providing said selectively filtered frequency range as a filtered electrical firing indicator signal output.

6. The controller of claim 5 further comprising a means for counting each electrical firing indicator signal and providing a count indicator signal after counting a predetermined number of electrical firing indicator signals, wherein said predetermined number is greater than one.

7. The controller of claim 6 further comprising means for adjusting said prolonging means to change a duration of said paint ball demand signal, said adjusting means performing said adjusting responsive to said count indicator signal.

8. The controller of claim 1 wherein said firing sensor further comprises a microphone.

9. The controller of claim 8 wherein said controller is mounted adjacent said agitator motor and said microphone is physically located within a housing surrounding said controller.

10. The controller of claim 8 wherein said controller is mounted adjacent said agitator motor and said microphone is physically located adjacent a housing surrounding said controller.

11. A sound activated relay for powering a paint ball magazine agitator comprising:

a microphone for receiving pressure waves and converting them to microphonic electrical waves;

an envelope threshold detector which detects when an envelope of said microphonic electrical waves exceeds a threshold voltage and provides a threshold output voltage representative thereof;

a timer responsive to said threshold output voltage for generating an extended duration pulse; and a relay which responds to said extended duration pulse and provides electrical energy to an agitator motor, said motor consequently providing motive power to said agitator.

12. The relay of claim 11 further comprising a filter for receiving electrical waves and filtering therefrom electrical waves characteristic of the firing of a paint ball gun.

13. The relay of claim 12 wherein said filter performs said filtering prior to said envelope detection.

14. A method of refilling a paint ball gun magazine feeder tube comprising the steps of:

detecting pressure waves in a medium;

initiating an electrical pulse responsive to said pressure waves of duration greater than a duration of said pressure waves;

activating a paint ball agitator responsive to said electrical pulse and thereby moving paint balls into said feeder tube, whereby said paint ball agitator is activated irrespective of the presence or absence of paint within said feeder tube and wherein said paint ball agitator activates responsive to firing.

15. The method of claim 14 comprising the further step of distinguishing waves in said medium originating from a firing of said paint ball gun from other waves in said medium; and using said firing waves to trigger said electrical pulse.

16. The controller of claim 6 wherein said predetermined number of electrical firing indicator signals equals in count a maximum quantity of paint balls contained within a paint ball magazine feed tube.

* * * * *